US007134614B2

(12) United States Patent
Miyake et al.

(10) Patent No.: US 7,134,614 B2
(45) Date of Patent: Nov. 14, 2006

(54) HAND-HELD SPRAYER FOR BATHROOM

(76) Inventors: Haru Miyake, 36-2, Yomogidai 1-chome, Meito-ku, Nagoya-shi, Aichi 465-0091 (JP); Takamura Miyake, 204-7, Ichiba, Nishihirose-cho, Toyota-shi, Aichi 470-0309 (JP)

( * ) Notice: Subject to any disclaimer, the term of this patent is extended or adjusted under 35 U.S.C. 154(b) by 0 days.

(21) Appl. No.: 10/544,044

(22) PCT Filed: Jan. 31, 2003

(86) PCT No.: PCT/JP03/00964

§ 371 (c)(1),
(2), (4) Date: Jul. 29, 2005

(87) PCT Pub. No.: WO2004/066799

PCT Pub. Date: Aug. 12, 2004

(65) Prior Publication Data

US 2006/0049279 A1 Mar. 9, 2006

(51) Int. Cl.
*A62C 31/00* (2006.01)

(52) U.S. Cl. ..... 239/436; 239/390; 239/437; 239/444; 239/445; 239/396; 239/393; 239/391

(58) Field of Classification Search ..... 239/444, 239/445, 447, 448, 436, 437, 390, 391, 393, 239/394, 396
See application file for complete search history.

(56) References Cited

U.S. PATENT DOCUMENTS 3,963,179 A * 6/1976 Tomaro ..... 239/101
4,165,837 A * 8/1979 Rundzaitis ..... 239/394
4,346,844 A * 8/1982 Harmony ..... 239/381
4,657,185 A * 4/1987 Rundzaitis ..... 239/438
4,674,687 A * 6/1987 Smith et al. ..... 239/447
4,703,893 A * 11/1987 Gruber ..... 239/391
4,838,486 A * 6/1989 Finkbeiner ..... 239/117
5,201,468 A 4/1993 Freier et al.
5,551,637 A * 9/1996 Lo ..... 239/394
5,765,760 A * 6/1998 Kuo ..... 239/440
5,772,120 A * 6/1998 Huber ..... 239/391
5,918,816 A * 7/1999 Huber ..... 239/391
6,286,158 B1 * 9/2001 Lin ..... 4/601
6,290,147 B1 * 9/2001 Bertrand et al. ..... 239/444

(Continued)

FOREIGN PATENT DOCUMENTS

JP 5-269406 A 10/1993

(Continued)

OTHER PUBLICATIONS

International Search Report dated Jun. 24, 2003 in PCT International Application No. PCT/JP03/00964.

*Primary Examiner*—David A. Scherbel
*Assistant Examiner*—Trevor McGraw
(74) *Attorney, Agent, or Firm*—Flynn, Thiel, Boutell & Tanis, P.C.

(57) ABSTRACT

A hand-held sprayer for bathroom capable of solving such a problem that an installation space for a sprayer is required at one corner of a bathroom, wherein a flow passage is formed in a casing (1), a spray nozzle (39) is connected to the tip of the flow passage, and the tip of the spray nozzle (39) is projected from the casing (1), whereby the conventional sprayer can be eliminated by fitting the hand-held sprayer to the feed water means of existing shower equipment (S), i.e., to the tip of a flexible tube (T).

9 Claims, 12 Drawing Sheets

U.S. PATENT DOCUMENTS 6,328,228 B1 * 12/2001 Bossini ..... 239/390
6,869,030 B1 * 3/2005 Blessing et al. ..... 239/394

FOREIGN PATENT DOCUMENTS

JP 2002-253994 A 9/2002

* cited by examiner

HAND-HELD SPRAYER FOR BATHROOM

TECHNICAL FIELD

The present invention relates to a hand-held sprayer attached to a tip end of a water supply means (a flexible tube) in a shower unit in a bathroom.

BACKGROUND ART

Conventionally, a sprayer for turning a bathroom into a low-temperature sauna is configured so that a spray faucet is formed in an upper portion of a box unit main body installed into the bathroom and so that fine water particles are ejected from the spray faucet.

However, the conventional sprayer has disadvantages. For example, since an installation space is required at a corner of the bathroom, the already narrow bathroom of an ordinary house is made narrower.

DISCLOSURE OF THE INVENTION

The present invention has been achieved to solve the conventional disadvantages. It is an object of the present invention to provide a hand-held sprayer characterized by forming a flow passage in a casing, connecting a spray nozzle to a tip end of the flow passage, and protruding a tip end of the spray nozzle from the upper front surface of the casing. By attaching the hand-held sprayer thus configured to water supply means, i.e., a tip end of a flexible tube of an existing shower unit, a bathroom can be filled with fine water particles without installing the other units into the bathroom.

Further, according to the present invention, there is provided a hand-held sprayer characterized in that a flow passage is formed in a casing, and at least one water-passing hole is provided to penetrate into a front surface of a tip end of the casing; a plurality of bottomed cylindrical cases each having a front opening are formed, front cases are coupled to adjacent rear cases by fitting bottoms of the front cases into front openings of the adjacent rear cases, respectively, a rearmost case is rotatably attached to the front surface of the tip end of said casing; a plurality of water-passing regions are provided to penetrate into the rearmost case, and a direct flow passage that connects all the water-passing regions except for at least one water-passing region to all the remaining cases is provided; a spray nozzle is connected to at least one of the cases, and various water discharge means are provided in the remaining cases; and a casing-side water-passing hole and a rearmost case-side water-passing region are formed so as not to simultaneously supply water to the different water discharge means. By attaching the hand-held sprayer thus configured to water supply means (a tip end of a flexible tube) of an existing shower unit and rotatably operating the rearmost case to thereby appropriately select a water discharge means, the hand-held sprayer includes functions other than a spray function.

BRIEF DESCRIPTION OF THE DRAWINGS

FIG. 10(*b*) is an exploded view that depicts positional relationships among a pan and first to third cases if the hand-held sprayer is used as the intermitten shower;

FIG. 10(*c*) is an exploded view that depicts positional relationships among a pan and first to third cases if the hand-held sprayer is used as the shower;

DETAILED DESCRIPTION OF THE INVENTION

Figure 1:
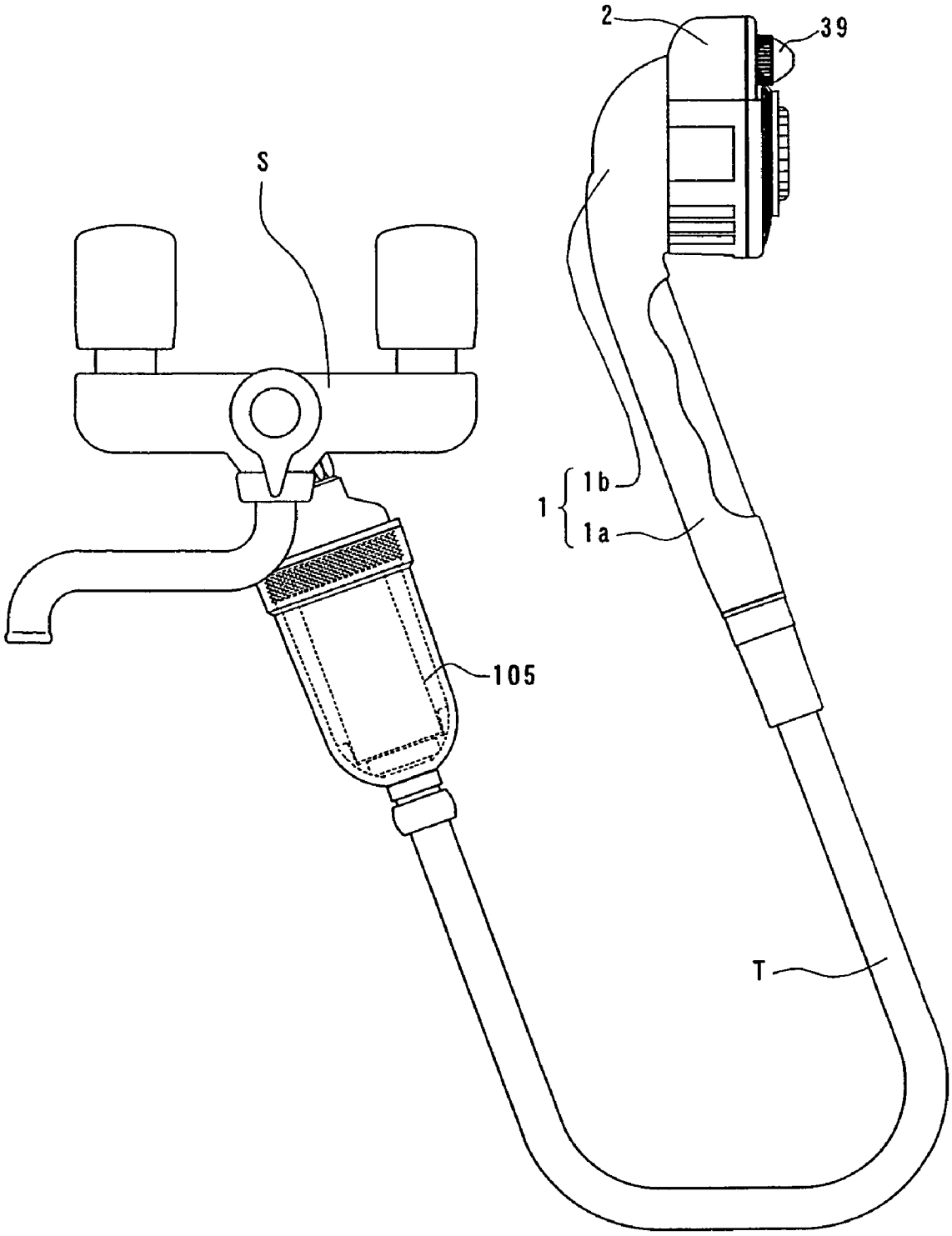
FIG. 1 is a side view of a multifunctional hand-held sprayer.
Figure 2:
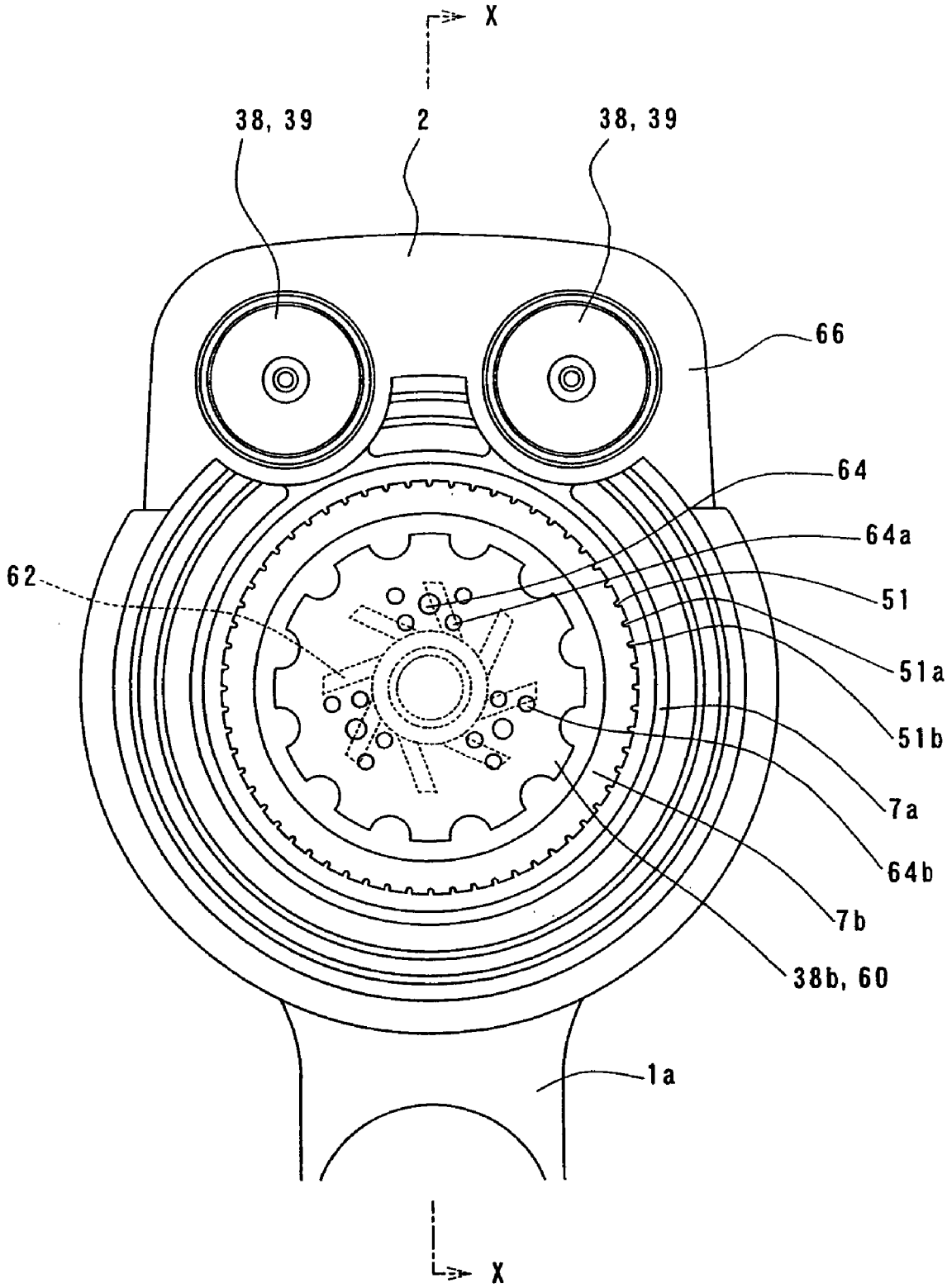
FIG. 2 is a front view that depicts a state in which the hand-held sprayer is used as a spray nozzle.
Figure 3:
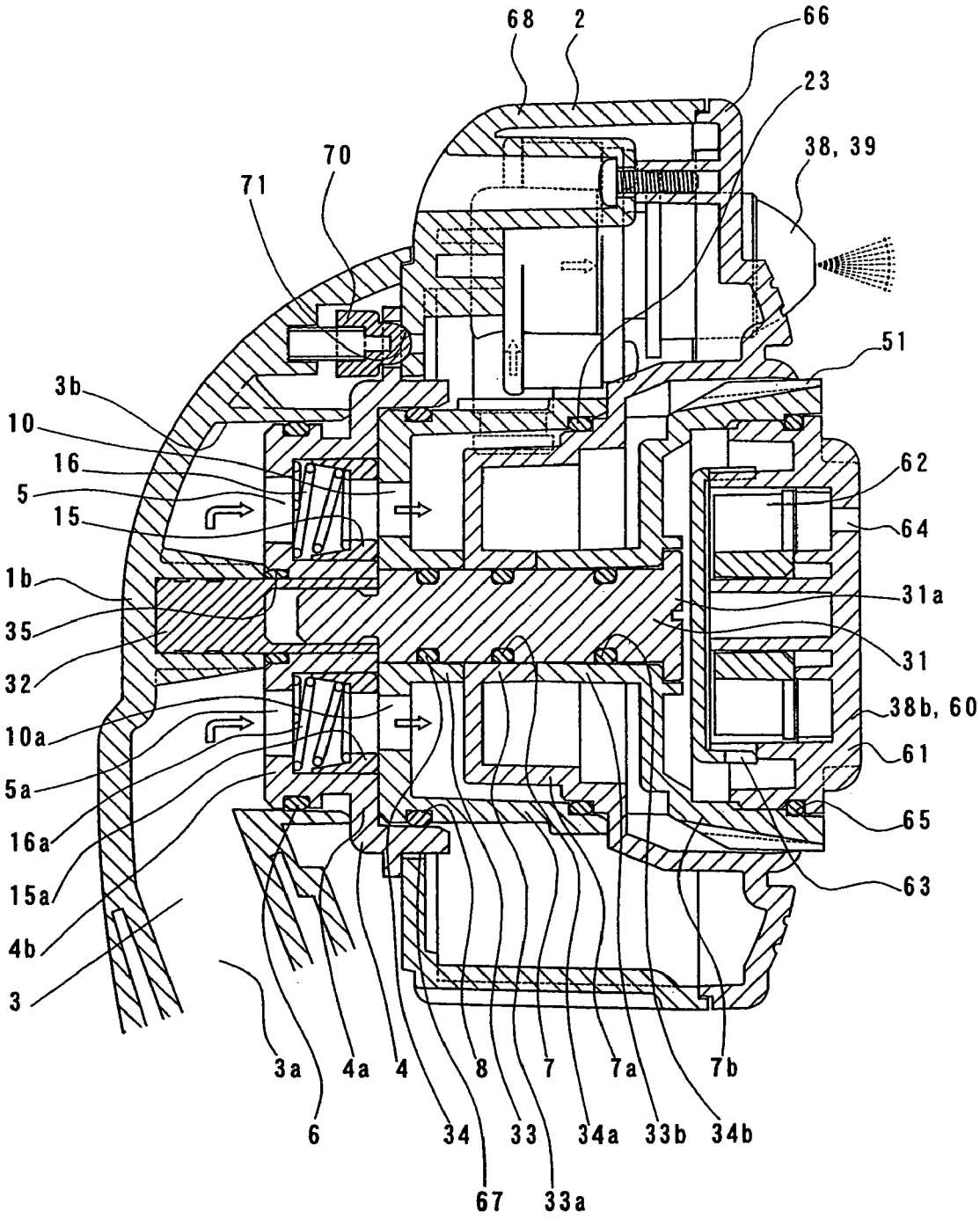
FIG. 3 is a cross-sectional view taken along X—X of FIG. 2.
Figure 4:
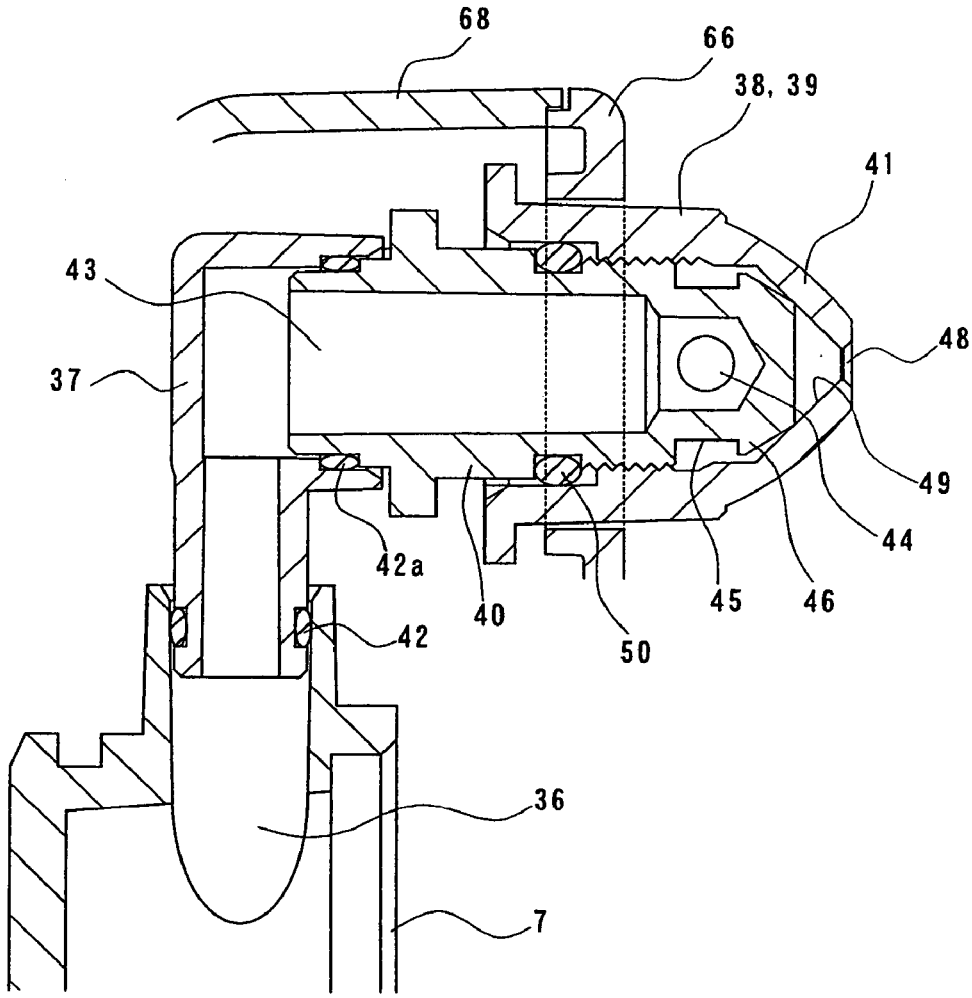
FIG. 4 is a cross-sectional view that depicts a spray nozzle installation state.
Figure 5:
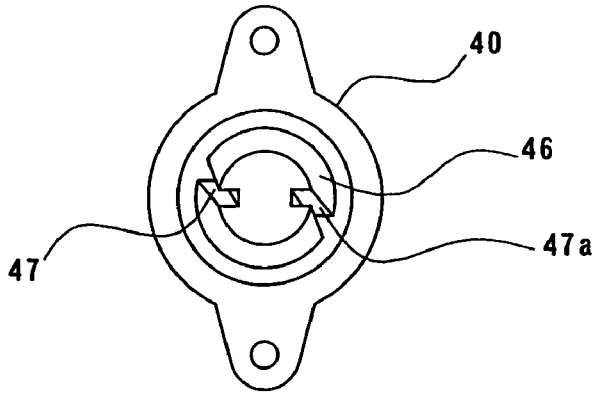
FIG. 5 is a front view of a nozzle main body of the spray nozzle.
Figure 6:
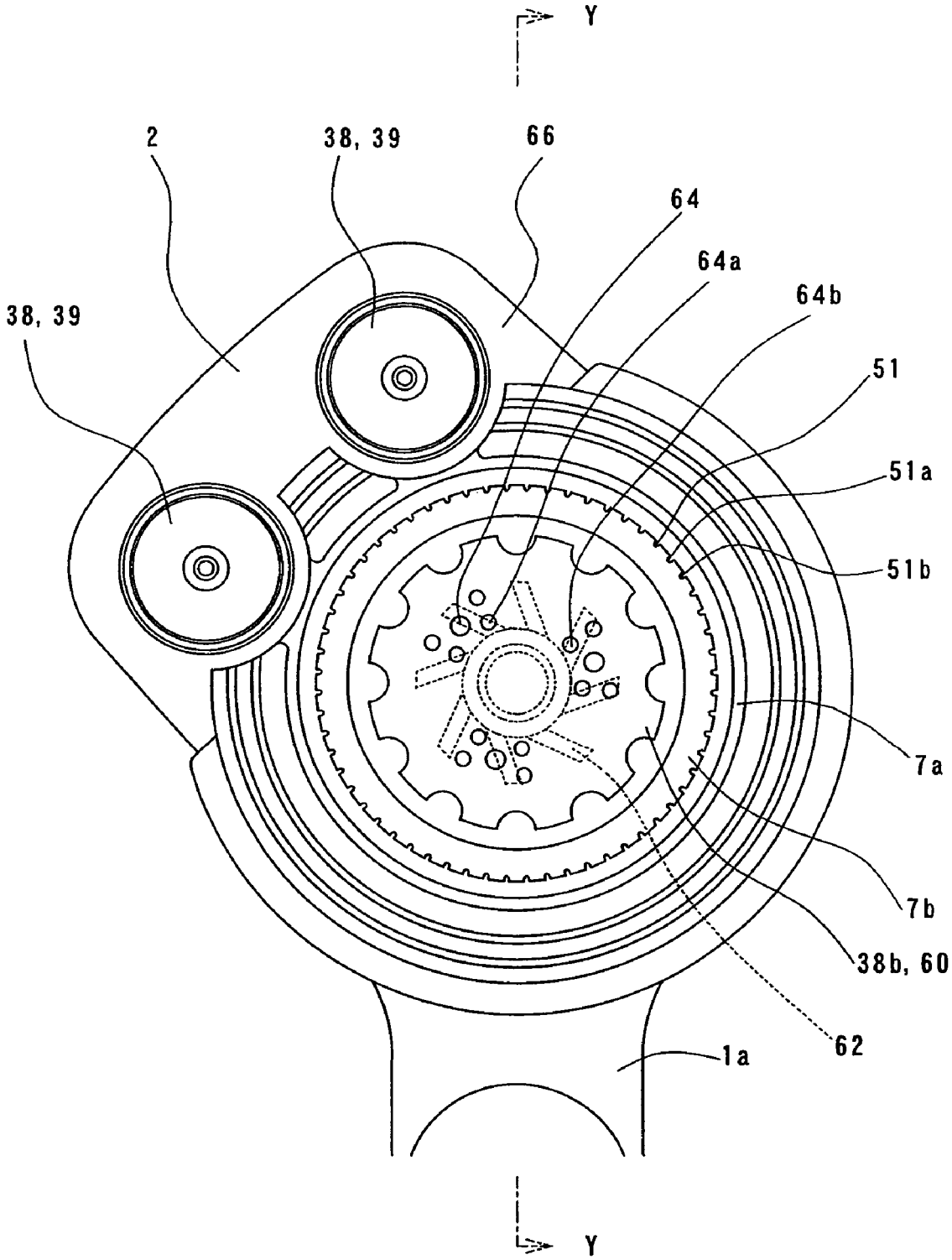
FIG. 6 is a front view that depicts a state in which the hand-held sprayer is used as an intermittent shower.
Figure 7:
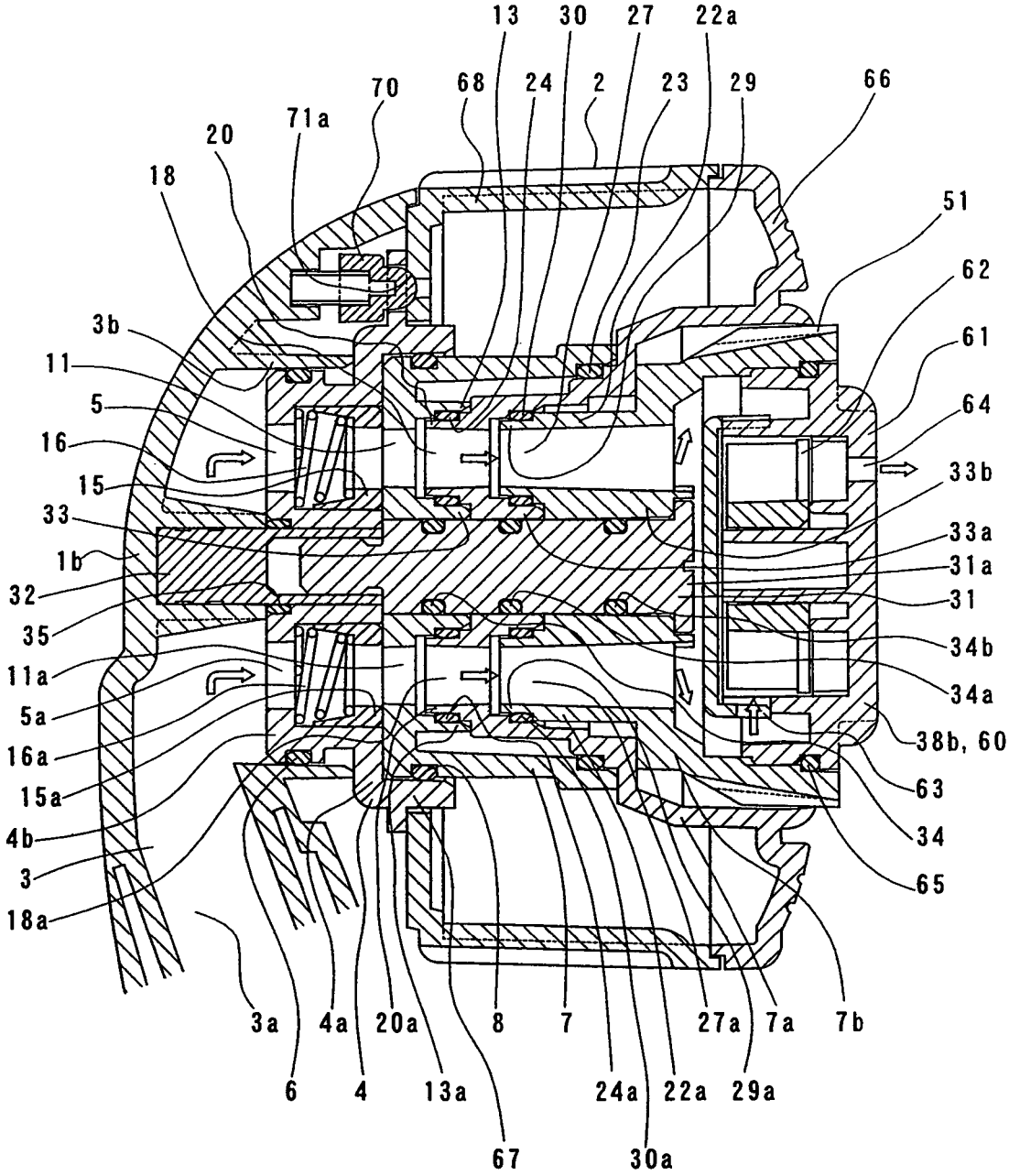
FIG. 7 is a cross-sectional view taken along Y—Y of FIG. 6.
Figure 8:
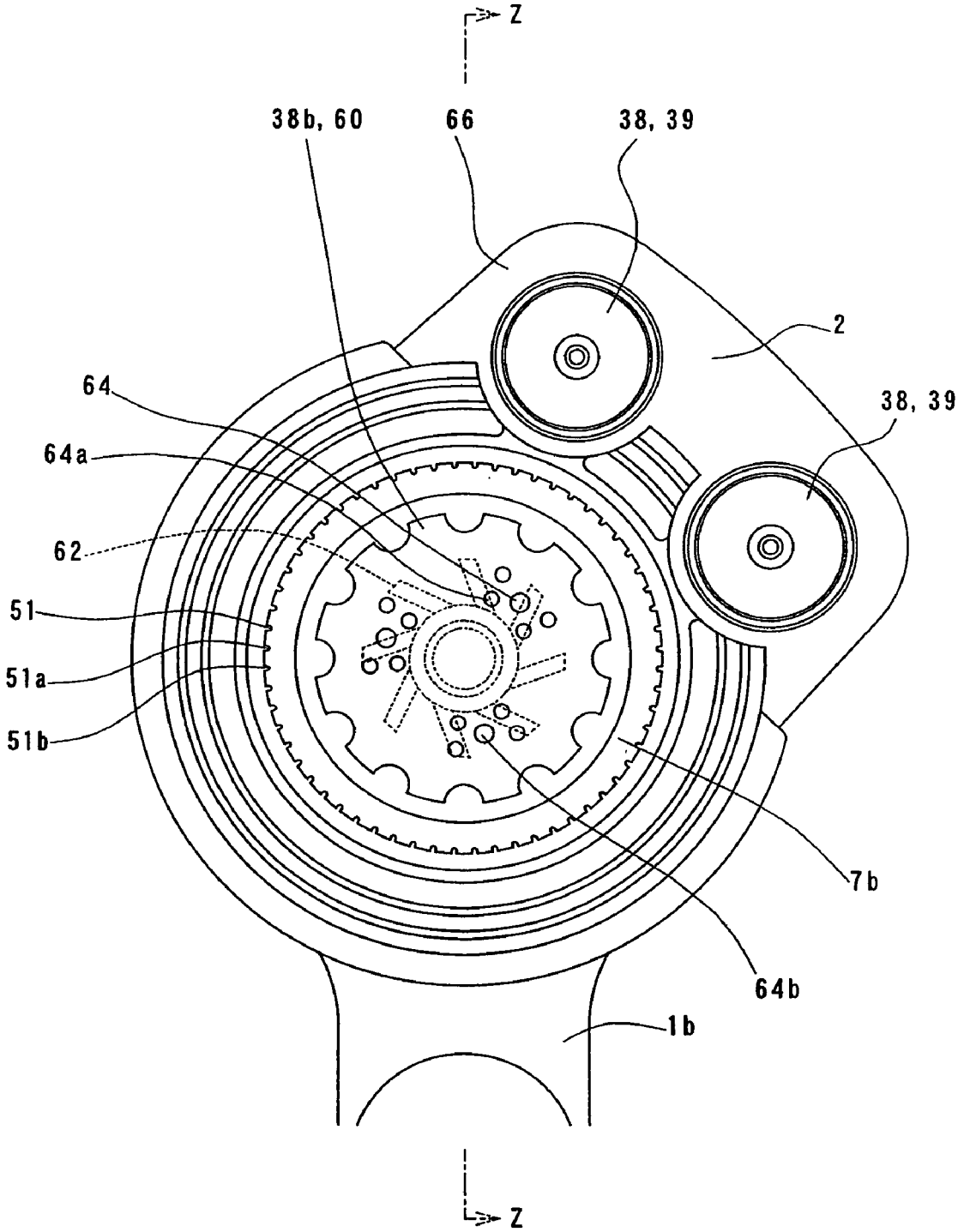
FIG. 8 is a front view that depicts a state in which the hand-held sprayer is used as a shower.
Figure 9:
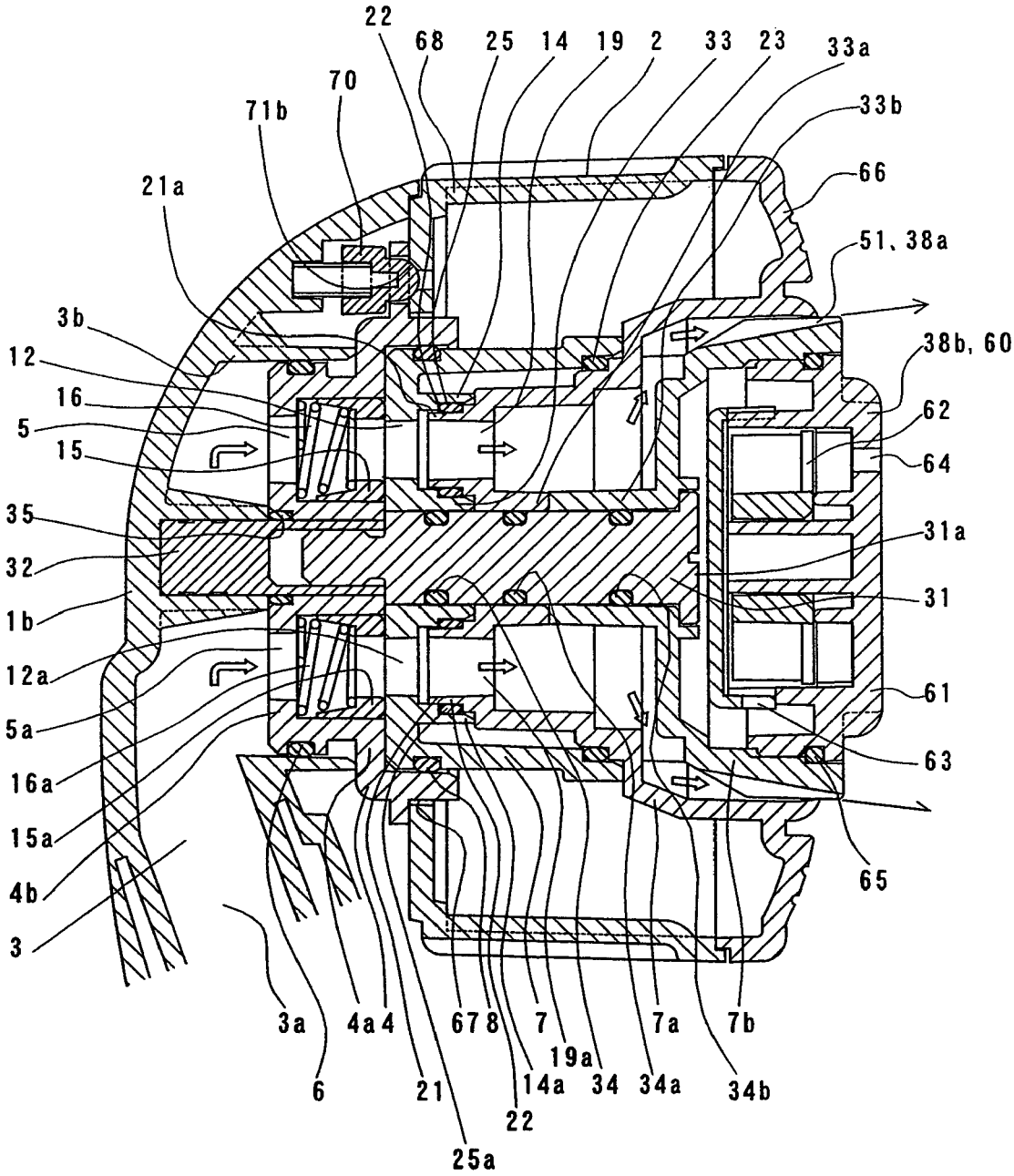
FIG. 9 is a cross-sectional view taken along Z—Z of FIG. 8.
Figures 10A, 10B, 10C:
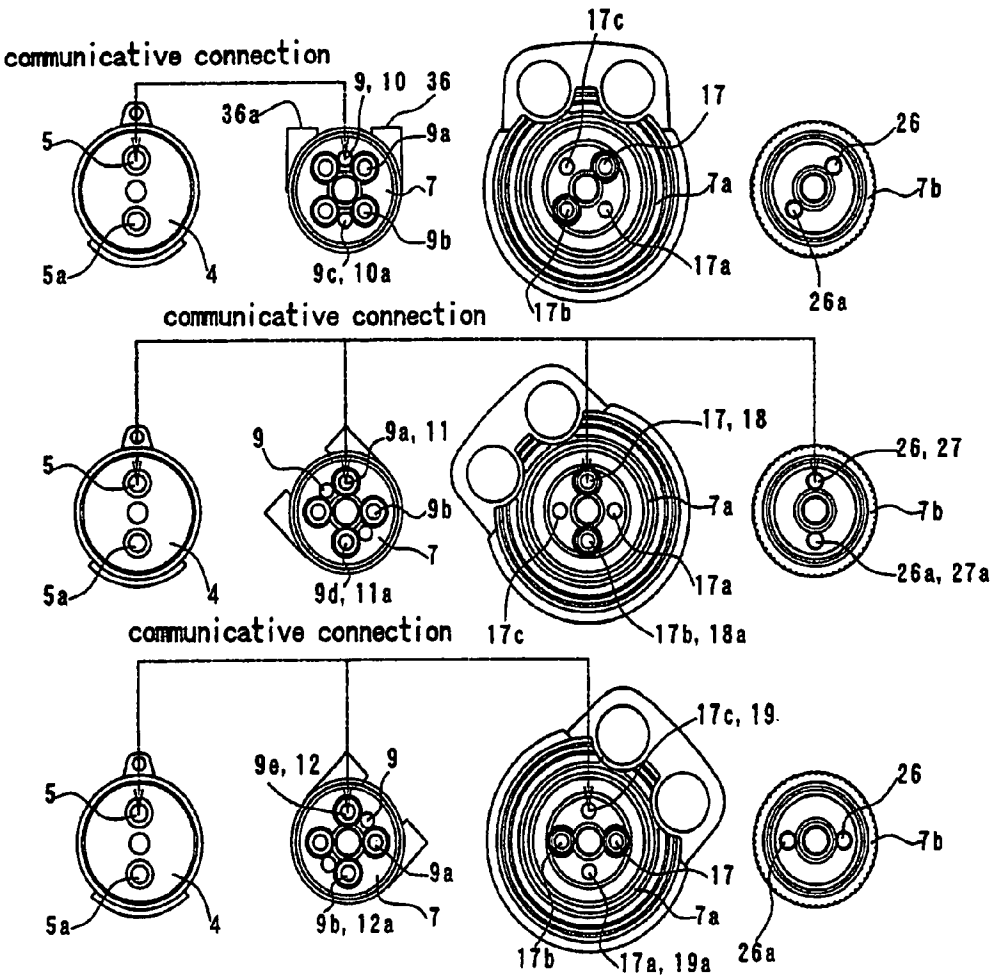
FIG. 10(*a*) is an exploded view that depicts positional relationships among a pan and first to third cases if the hand-held sprayer is used as the spray nozzle.

An embodiment of the present invention will be described hereinafter with reference to the drawings. FIG. 1 is a side view of a multifunctional hand-held sprayer of the present invention; FIG. 2 is a front view that depicts a state in which the hand-held sprayer is used as a spray nozzle; FIG. 3 is a cross-sectional view taken along X—X of FIG. 2; FIG. 4 is a cross-sectional view that depicts a spray nozzle installation state; FIG. 5 is a front view of a nozzle main body of the spray nozzle; FIG. 6 is a front view that depicts a state in which the hand-held sprayer is used as an intermittent shower; FIG. 7 is a cross-sectional view taken along Y—Y of FIG. 6; FIG. 8 is a front view of important parts that depicts a state in which the hand-held sprayer is used as a shower; FIG. 9 is a cross-sectional view taken along Z—Z of FIG. 8; FIGS. 10(*a*)–10(*c*) are exploded views thats depict positional relationships among a pan and first to third cases if the hand-held sprayer is used as the spray nozzle, the intermittent shower, or the shower, respectively.

As shown in FIG. 1, the hand-held sprayer according to the present invention is configured so that a switching portion 2 provided with various water discharge means is rotatably attached to a front surface of an upper end of a casing 1 which is attached to the tip end of flexible tube T of a shower unit S.

A proximal end of a casing 1 serves as a grip 1*a* and a tip end thereof serves as a head 1*b*, and the switching portion 2 is provided on a front surface of the head 1*b*.

A flow passage 3 is formed within the casing 1. As shown in FIGS. 3, 7, and 9, the flow passage 3 is formed by connecting a tip end of a water supply tube 3*a* provided in the grip 1*a* to a large-diameter cylindrical portion 3*b* formed integrally with the water supply tube 3*a* at a center of the head 1*b*, and the flexible tube T is connected to a proximal end of the flow passage 3 (water supply tube 3*a*).

A pan 4 is provided in front of the cylindrical portion 3*b*. The pan 4 is configured so that a fitted body 4*b* fitted into a front opening of the cylindrical portion 3*b* is formed integrally on a rear surface of the circular pan main body 4*a*.

A pair of water-passing holes 5 and 5*a* are formed in portions other than a center of the pan 4, and located on a line of a diameter of a concentric circle formed around the center of the pan 4.

An O ring 6 is provided between the fitted body 4*b* of the pan 4 and an inner peripheral surface of the cylindrical portion 3*b* so as to keep watertight therebetween.

A bottom of a bottomed cylindrical first case 7 is rotatably fitted into the pan 4, whereby an inner bottom of a pan main body 4*a* of the pan 4 is closely attached to the bottom of the first case 7.

An O ring 8 is provided between an outer peripheral surface of the pan 4 and an inner peripheral surface of the first case 7 so as to keep watertight therebetween.

A plurality of water-passing regions 9, 9*a*, etc. are provided to penetrate into the bottom of the first case 7. The water-passing regions 9, 9*a*, etc. are classified into three pairs or six water-passing holes 10, 10*a*, 11, 11*a*, 12, and 12*a*. The water-passing holes 10, 10*a*, 11, 11*a*, 12, and 12*a* are arranged on a concentric circle formed around a rotation center of the first case 7. By rotating the first case 7, each pair of the water-passing holes 10, 10*a*, 11, 11*a*, 12, and 12*a* can communicate with the water-passing holes 5 and 5*a* of the pan 4.

Fitted cylindrical portions 13, 13*a*, 14, and 14*a* are provided to protrude from inner bottom-side outer peripheral portions of the water-passing holes 11, 11*a*, 12, and 12*a* except for the water-passing holes 10 and 10*a*.

The water-passing holes 5 and 5*a* of the pan 4 are configured as stepped holes each having a large-diameter region on a front side. Cylindrical packings 15 and 15*a* are fitted into the large-diameter regions of the water-passing holes 5 and 5*a*, respectively, and compressive springs 16 and 16*a* are interposed between the packings 15 and 15*a* and the stepped regions of the water-passing holes 5 and 5*a*. The packings 15 and 15*a* are thereby constantly watertight attached to the bottom of the first case 7.

A bottom of a bottomed cylindrical second case 7*a* is fitted into a front opening of the first case 7, and a plurality of water-passing regions 17, 17*a*, etc. are provided to penetrate into the bottom of the second case 7*a*. The water-passing regions 17, 17*a*, etc. are classified into two pairs or four water-passing holes 18, 18*a*, 19, and 19*a*. Fitted cylindrical portions 20, 20*a*, 21, and 21*a* are provided to protrude from bottom-side outer peripheral portions of the respective water-passing holes 18, 18*a*, 19, and 19*a*. The fitted cylindrical portions 20, 20*a*, 21, and 21*a* are coupled to the fitted cylindrical portions 13, 13*a*, 14, and 14*a* of the first case 7, respectively. The water-passing holes 12 and 12*a* and fitted cylindrical portions 14 and 14*a* of the first case 7, and the fitted cylindrical portions 21 and 21*a* and water-passing holes 19 and 19*a* of the second case 7*a* form direct flow passages 22, 22 that directly supply water from the water-passing holes 12 and 12*a* to the second case 7*a* without causing the water to flow into the first case 7.

Further, O rings 23, 24, 24*a*, 25, and 25*a* are provided between outer peripheral walls of the first and second cases 7 and 7*a*, and between inner and outer peripheral surfaces of regions in which the fitted cylindrical portions 13, 13*a*, 14, and 14*a* of the first case 7 are coupled to the fitted cylindrical portions 20, 20*a*, 21, and 21*a* of the second case 7*a* so as to keep watertight therebetween.

A bottom of a bottomed cylindrical third case 7*b* is fitted into a front opening of the second case 7*a*. A plurality of (two in the drawings) water-passing regions 26 and 26*a* are provided to penetrate into the bottom of the third case 7*b*. A pair of water-passing holes 26 and 26*a* serve as two water-passing holes 27 and 27*a*, respectively, fitted cylindrical portions 29 and 29*a* are provided to protrude from bottom-side outer peripheral portions of the respective water-passing holes 27 and 27*a*, and tip ends of the fitted cylindrical portions 29 and 29*a* are coupled to the water-passing holes 18 and 18*a* of the second case 7*a*. The water-passing holes 11 and 11*a* and fitted cylindrical portions 13 and 13*a* of the first case 7, the fitted cylindrical portions 20 and 20*a* and water-passing holes 18 and 18*a* of the second case 7*a*, and the fitted cylindrical portions 29 and 29*a* and water-passing holes 27 and 27*a* of the third case 7*b* form direct flow passages 22*a*, 22*a* that directly supply water from the water-passing holes 11 and 11*a* to the third case 7*b* without causing the water to flow into the first and second cases 7 and 7*b*.

O rings 30 and 30*a* are provided between inner peripheral surfaces of the water-passing holes 18 and 18*a* of the second case 7*a* and outer peripheral surfaces of tip ends of the fitted cylindrical portions 29 and 29*a* of the third case 7*b* so as to keep watertight therebetween, respectively.

A center shaft 31 penetrates into centers of the first, second, and third cases 7, 7*a*, and 7*b*. A tip end of the center shaft 31 is provided in a central portion of the cylindrical portion 3*b* of the head 1*b*, and screwed into a nut member 32 that penetrates into the central portion of the pan 4. A plate head body 31*a* is formed integrally with a proximal end of the center shaft 31, thereby integrating the first, second, and third cases 7, 7*a*, and 7*b* with one another and closely attaching the inner bottom of the pan main body 4*a* of the pan 4 to the bottom of the first case 7.

Cylindrical members 33, 33*a*, and 33*b* into which the center shaft 31 penetrates are integrally provided to protrude from regions of the respective first, second, and third cases 7, 7*a*, and 7*b* into which the center shaft 31 penetrates. O rings 34, 34*a*, and 34*b* are provided between the cylindrical members 33, 33*a*, and 33*b* and the center shaft 31, respectively.

Further, an O ring 35 is provided between an inner peripheral surface of a region of the pan 4 into which the nut member 32 penetrates and an outer peripheral surface of the nut member 32.

A plurality of (two in the drawings) attachment ports 36 and 36 are formed in a peripheral wall of the first case 7, a proximal end of a connection tube 37 bent at right angle is coupled to the attachment ports 36 and 36*a*, and a spray nozzle 39 serving as one of water discharge means 38, 38*a*, etc. is connected to a tip end of the connection tube 37.

The spray nozzle 39 is formed by covering a tip end of a nozzle main body 40 connected to the connection tube 37 with a cap 41.

O rings 42 and 42*a* are provided between inner peripheral surfaces of the attachment ports 36 and 36*a* and an outer peripheral surface of the connection tube 37, and between inner and outer peripheral surfaces of a connection region in which the nozzle main body 40 is connected to the connection tube 37 so as to keep watertight therebetween.

A flow passage 43 communicating with the connection tube 37 is formed at a center of the nozzle main body 40. An ejection hole 44 that penetrates into the flow passage 43 from a side surface of a tip end of the nozzle main body 40 is formed without opening a tip end of the flow passage 43 on a tip end surface of the nozzle main body 40 so that the tip end of the flow passage 43 is opened on the side surface of the tip end of the nozzle main body 40.

A diameter of a tip end-side portion of an inner region of the cap 41 of the nozzle main body 40 is reduced, and a truncated cone-like increased-diameter portion 46 is formed on a tip end of the reduced-diameter portion 45. In addition, a plurality of grooves 47, 47*a*, etc. are formed on an outer peripheral surface of the increased-diameter portion 46 so as to be slightly inclined from a bus line direction of the outer peripheral surface of the increased-diameter portion 46.

A spray hole 48 is formed at a center of a tip end surface of the cap 41, and a depth region of an inner peripheral surface of the cap 41 is formed into a tapered surface 49 tapered in a depth direction.

Screw threads and thread grooves are formed on an outer peripheral surface of the nozzle main body 40 in rear of the reduced-diameter portion 45 and opening-side regions on the inner peripheral surface of cap 41. The cap 41 is screwed into and covered on the tip end of the nozzle main body 40.

An O ring 50 is formed between inner and outer peripheral surfaces of the nozzle main body 40 and the cap 41 in rear of the screw threads and screw grooves so as to keep watertight therebetween.

A plurality of water discharge grooves 51, 51*a*, etc. are formed on an outer peripheral wall surface of the third case 7*b*, one of the water discharge means 38, 38*a*, etc. is formed between the second and third cases 7*a* and 7*b*, and the water discharge grooves 51, 51*a*, etc. are formed to be gradually shallower toward a front side.

Further, the water discharge grooves 51, 51*a*, etc. are formed so as to regularly mix the grooves different in width and depth.

A spray portion 60 serving as one of the water discharge means 38, 38*a*, etc. is fitted into a front opening of the third case 7*b*, and vanes 62 are rotatably provided within a casing 61 of the spray portion 60. In addition, a plurality of water intake holes 63 are provided to penetrate into an outer peripheral surface of the casing 61, and water discharge holes 64, 64*a*, etc. are provided to penetrate into a front surface of the casing 61.

The vanes 62 are made rotatable by setting a direction of forming the water intake holes 63 not to be equal to a centripetal direction of the casing 61.

An O ring 65 is formed between a region on the outer peripheral surface of the casing 61 whose region is in front of the water intake holes 63 and the inner peripheral surface of the third case 7*b* so as to keep watertight therebetween.

As shown in FIGS. 3, 7, and 9, the second case 7*a* is formed integrally with a front cover 66, and a rear cover 68 in which a region 67 into which the pan 4 penetrates is formed is fixed to the front cover 66 by screw means or the like. In addition, the spray nozzle 39 is accommodated in the front cover 66 and the rear cover 68, a tip end of the spray nozzle 39 penetrates into the front cover 66 and thereby protrudes to the front side.

A freely back and forth stopper 70 is provided outside the cylindrical portion 3*b* in the head 1*b* of the casing 1, and engagement portions 71, 71*a*, etc. of a tip end of the stopper 70 are formed on a rear surface of the rear cover 68.

In this embodiment, the hand-held sprayer is configured by the three cases 7, 7*a*, and 7*b*. However, the number of cases is not limited to three but may be four or more. Namely, it suffices that the hand-held sprayer is configured as follows.

The hand-held sprayer may be configured so that a plurality of bottomed cylindrical cases 7, 7*a*, etc. each having a front opening are formed, front cases 7*a*, 7*b*, etc. are coupled to adjacent rear cases 7, 7*a*, etc. by fitting bottoms of the front cases 7*a*, 7*b*, etc. into front openings of the adjacent rear cases 7, 7*a*, etc., respectively, a rearmost case 7 is rotatably attached to the front surface of the tip end of the casing 1; a plurality of water-passing regions 9, 9*a*, etc. are provided to penetrate into the rearmost case 7 and arranged on a concentric circle formed around a rotation center of the rearmost case 7, and direct flow passages 22, 22*a*, etc. that connect all the water-passing regions 9, 9*a*, etc. except for at least one water-passing region to all the remaining cases 7*a*, 7*b*, etc. are provided; various water discharge means 38, 38*a*, etc. are provided in all the cases 7, 7*a*, etc.; and so that casing 1-side water-passing holes 5 and 5*a* and rearmost case 7-side water-passing regions 9, 9*a*, etc. are formed so as not to simultaneously supply water to the different water discharge means 38, 38*a*, etc.

Alternatively, a plurality of pairs of water-passing holes 5 and 5*a* may be formed on the casing 1 side without concentrically arranging a plurality of water-passing regions 9, 9*a*, etc. in the rearmost case 7, and the water-passing regions 9, 9*a*, etc. on the rearmost case 7 side may be formed so as not to simultaneously supply water to the different water discharge means 38, 38*a*, etc.

In the above-stated embodiment, the multifunctional hand-held sprayer has been described. In short, it suffices that the hand-held sprayer is configured so that the front portion of at least one spray nozzle 39 protrudes from the front portion of the casing 1 and so that the proximal end of the spray nozzle 39 is connected to the tip end of the flow passage 3.

Figure 11:
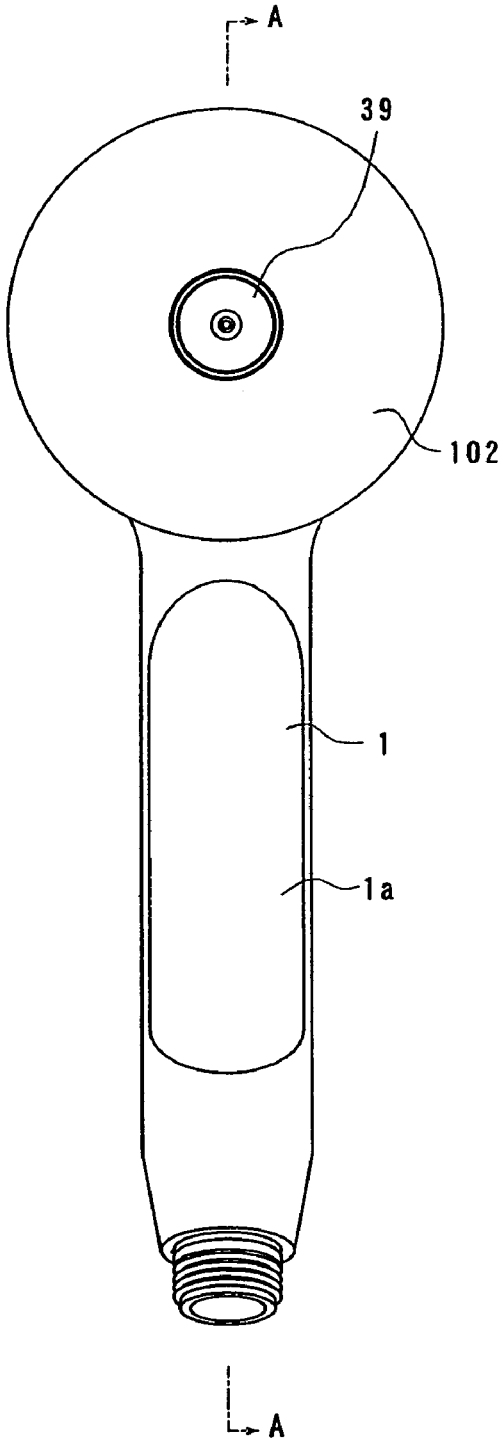
FIG. 11 is a front view of the hand-held sprayer that includes only the spray nozzle.
Figure 12:
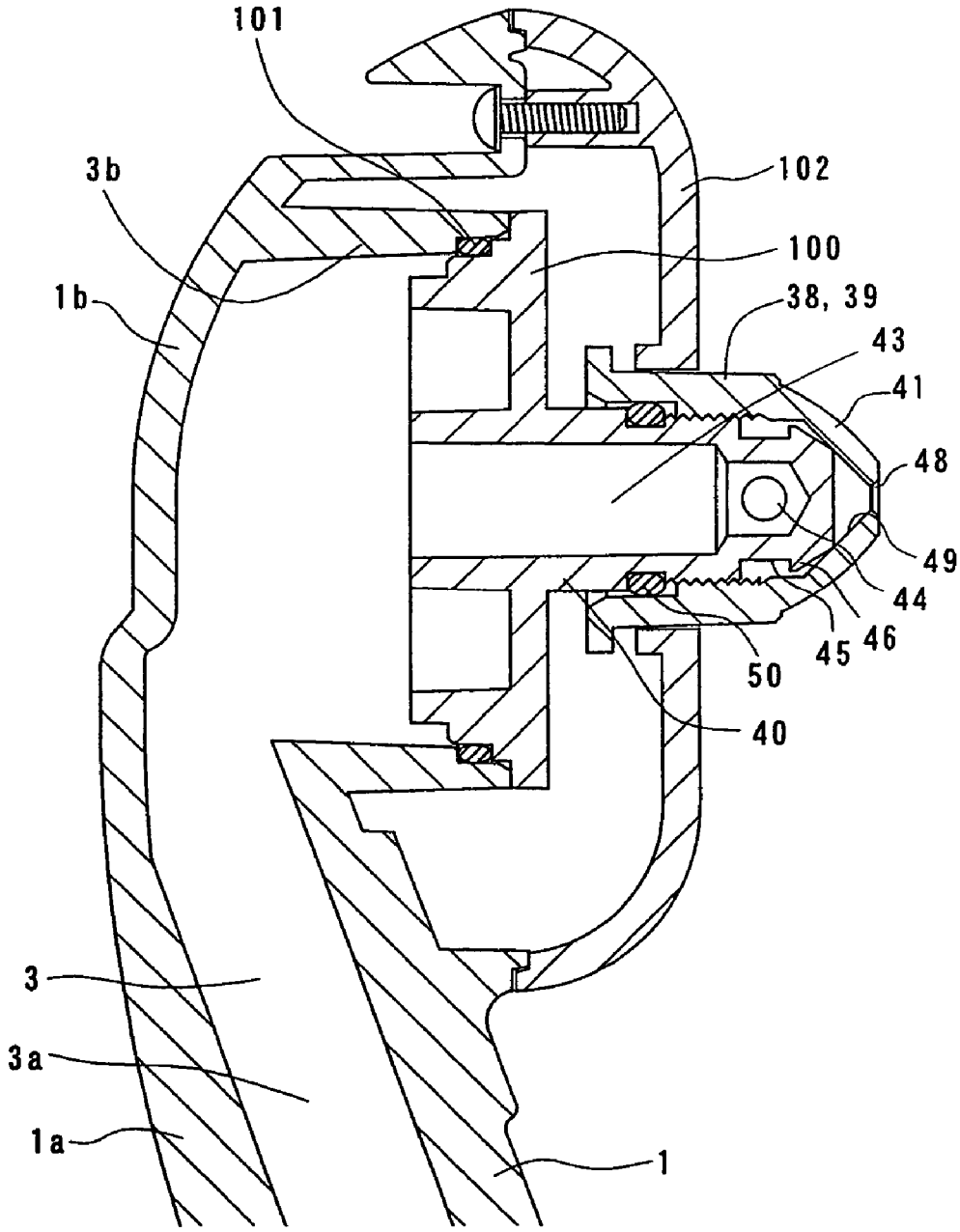
FIG. 12 is an enlarged view of important parts taken along A—A of FIG. 11.

Specifically, as shown in FIGS. 11 and 12, the spray nozzle 39 is provided in front of the cylindrical portion 3*b* of the casing 1. A collar-like closing plate 100 is formed integrally with an intermediate portion of the nozzle main body 40 of the spray nozzle 39. The closing plate 100 closes the front opening of the cylindrical portion 3*b*, and an O ring 101 is provided between the inner peripheral surface of the cylindrical portion 3*b* and an outer side surface of the closing plate 100 so as to keep watertight therebetween.

A cover body 102 is provided in a front portion of the head 1*b* of the casing 1, and the tip end of the spray nozzle 39 protrudes from a central portion of the cover body 102.

As shown in FIG. 1, a filter unit 105 may be provided on the proximal end of the flexible tube T so as to remove impurities within running water.

Functions of the hand-held sprayer according to the present invention will next be described.

In the hand-held sprayer shown in FIGS. 11 and 12, water is caused to directly flow into the flow passage 43 of the nozzle main body 40 from the flow passage 3, and supplied between the cap 41 and the reduced-diameter portion 45 by the ejection hole 44 on the side surface of the tip end of the nozzle main body 40. Thereafter, the water is ejected from gaps between the cap 41 and the increased-diameter portion 46 or, if no gaps are present, from outlet sides of the grooves 47, 47*a*, etc., filled up into a space between the tip end of the nozzle main body 40 and the cap 41, and sprayed from the spray hole 48 in the form of foggy fine water particles.

Since the water flow passage within the spray nozzle 39 is gradually narrower toward the tip end, water pressure is gradually increased and the fine water particles are ejected from the spray hole 48 with high efficiency.

By making a restriction amount of the spray nozzle 39 adjustable by fastening or unfastening the cap 41, diameters of the fine water particles ejected from the spray hole 48 can be adjusted. Specifically, if the cap 41 is fastened, the tapered surface 49 finally abuts on an outer peripheral edge of the increased-diameter portion 46. In this case, water is discharged only from the outlet sides of the grooves 47, 47*a*, etc., and ejected from the spray hole 48 with the water pressure quite increased. Due to this, the water is transformed into foggy and very fine water particles.

The water is suddenly transformed into fine particles during ejection from the spray hole 48, surface energy of these fine air particles is changed, and the fine water particles are positively charged, whereby the surrounding air is negatively charged. It is normally believed that hydroxyl ions ($OH^-+(H_2O)_n$) obtained by bonding $OH^-$ ions with water molecules in the air are mainly generated.

If the hydroxyl ions are absorbed into a human body by breathing, most of active oxygen that is generated during breathing and that adversely influences the human body is reduced by excess electrons contained in the negatively-charged air. A residual amount of the active oxygen in the body can be, therefore, minimized. In addition, lactic acid that causes stiffness of the shoulder is decomposed and thereby made harmless, autonomic nerves for metabolism can be stabilized, and potentials of cell membranes are affected. This thereby improves permeability of the cell membranes, smoothes input and output of nutritious substances, waste materials and the like, and thereby favorably influences the human body.

By directly pouring the foggy fine water particles onto the human body or filling the bathroom with high-temperature fine water particles produced from hot water, the bathroom is heated or turned into a low-temperature sauna.

It is noted that the pressure of warm water supplied to each house differs according to, for example, a performance of a hot water supply system. By adjusting the restriction amount of the spray nozzle 39, therefore, heating efficiency for heating the bathroom can be improved.

The functions of the hand-held sprayer shown in FIGS. 1 to 9 are as follows.

As shown in FIGS. 2 to 4, during usage of the spray nozzle 39, if water flows into the flow passage 43 of the nozzle main body 40 through the water-passing holes 5, 5*a*, 10, 10*a*, an interior of the first case 7, the attachment ports 36 and 36*a*, and the connection tube 37, the fine water particles are ejected from the spray hole 48 with high efficiency by the same functions as those shown in FIGS. 11 and 12.

If the hand-held sprayer is used as "an intermittent shower", then water is supplied into the third case 7*b* through the water-passing holes 5 and 5*a* and the direct flow passages 22*a*, 22*a* (the water-passing holes 11 and 11*a* and fitted cylindrical portions 13 and 13*a* of the first case 7, the fitted cylindrical portions 20 and 20*a* and water-passing holes 18 and 18*a* of the second case 7*a*, and the fitted cylindrical portions 29 and 29*a* and water-passing holes 27 and 27*a* of the third case 7*b*), and flows into the spray portion 60 from plurality of the water intake holes 63 of the spray portion 60, whereby the water rotates the vanes 62 and are ejected from the water discharge holes 64, 64*a*, etc, as shown in FIGS. 6 and 7.

At that time, the water discharge holes 64, 64*a*, etc. are intermittently and repeatedly opened or closed by the rotating vanes 62, so that the water is ejected in the form of an elongated block and "flows with torrential force".

If the hand-held sprayer is used as "a shower", then water is supplied into the second case 7*a* through the water-passing holes 5 and 5*a* and the direct flow passages 22, 22 (the water-passing holes 12 and 12*a* and fitted cylindrical portions 14 and 14*a* of the first case 7, and the fitted cylindrical portions 21 and 21*a* and water-passing holes 19 and 19*a* of the second case 7*a*), transformed into a plurality of water strips by water the discharge grooves 51, 51*a*, etc., and ejected therefrom, as shown in FIGS. 8 and 9.

Figure 13:
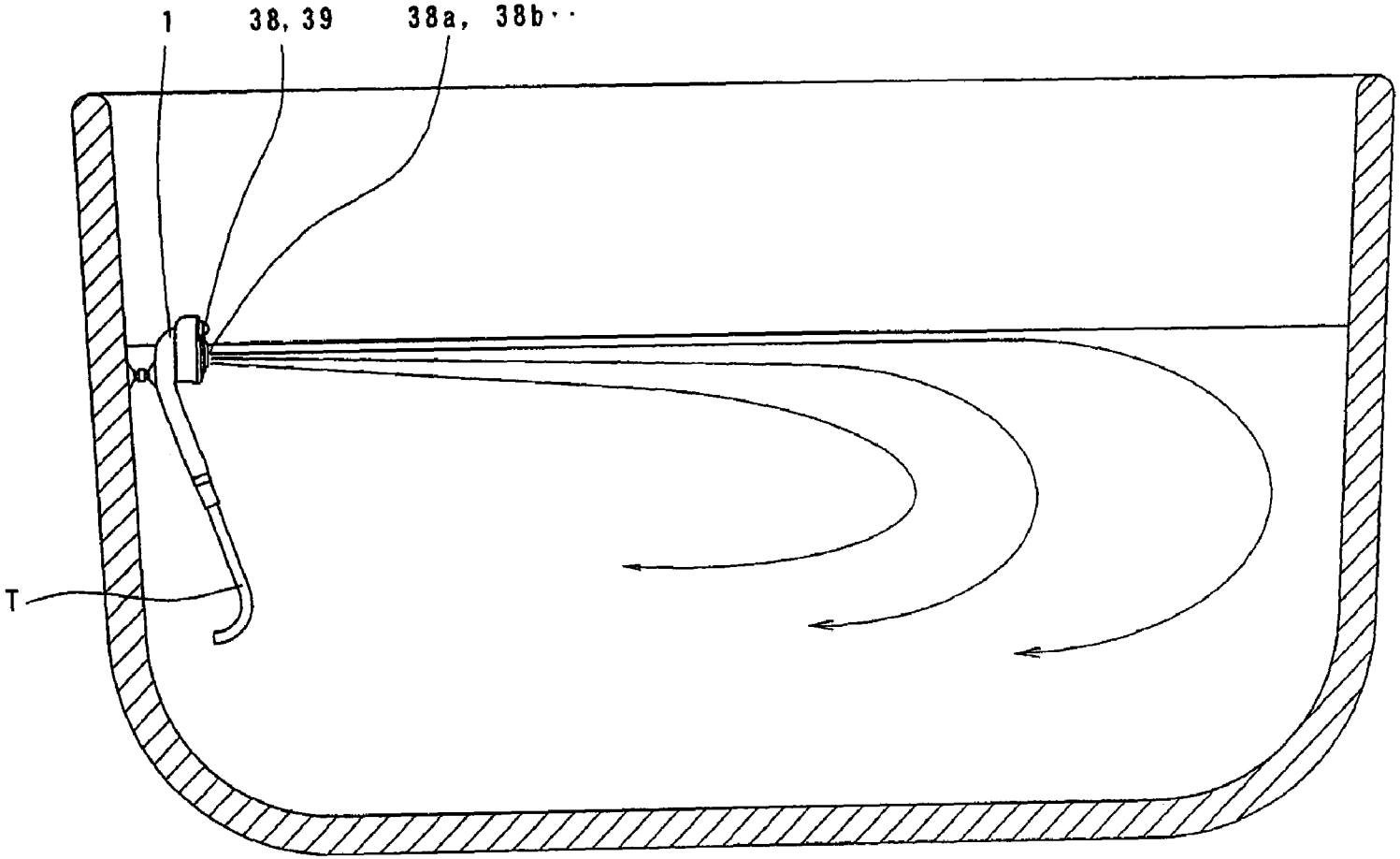
FIG. 13 is a cross-sectional view that depicts a usage state of the hand-held sprayer for generating a jet stream in a bathroom.

As shown in FIG. 13, if the water is ejected while fixing the head 1*b* of the hand-held sprayer to an inner wall of a bathtub, a jet stream is generated in the bathtub.

INDUSTRIAL APPLICABILITY

In summary, according to the present invention, the flow passage 3 is formed in the casing 1, the spray nozzle 39 is connected to the tip end of the flow passage 3, and the tip end of the spray nozzle 39 protrudes from the casing 1. Therefore, if the flexible tube T of the existing shower unit S is connected to the proximal end of the flow passage 3 of the casing 1, it can be ensured that fine water particles are ejected from the spray nozzle 39. Due to this, it is possible to generate the negatively-charged air by the Lenard effect to cause the air to act on the human body, and warm the bathroom or turn the bathroom into the low-temperature sauna. The existing shower unit S can be used without additionally installing water supply and hot water supply systems for the spray nozzle 39.

The flow passage 3 is formed in the casing 1, and at least one water-passing hole 5 or 5*a* is provided to penetrate into the front surface of the tip end of the casing 1. Therefore, if the flexible tube T of the existing shower unit S is connected to the proximal end of the flow passage 3 of the casing 1, it can be ensured that water is supplied from the water-passing holes 5 and 5*a* to the various water discharge means 38, 38*a*, etc.

A plurality of bottomed cylindrical cases 7, 7*a*, etc. each having the front opening are formed, front cases 7*a*, 7*b*, etc. are coupled to adjacent rear cases 7, 7*a*, etc. by fitting the bottoms of the front cases 7*a*, 7*b*, etc. into front openings of the adjacent rear cases 7, 7*a*, etc., respectively, and the rearmost case 7 is rotatably attached to the front surface of the tip end of the casing 1. Therefore, only by rotatably operating the rearmost case 7, it is possible to switch over to any one of the water discharge means 38, 38*a*, etc. A usage according to a purpose can be thereby easily selected.

A plurality of water-passing regions 9, 9*a*, etc. are provided to penetrate into the rearmost case 7, and the direct flow passages 22, 22*a*, etc. that connect all the water-passing regions 9, 9*a*, etc. except for at least one water-passing region to all the remaining cases 7*a*, 7*b*, etc. are provided. Therefore, it is possible to ensure that water is supplied from the casing 1 to the respective cases 7, 7*a*, etc.

The spray nozzle 39 is connected to at least one case 7, and the various water discharge means 38*a*, 38*b*, etc. are provided in the remaining cases 7*a*, 7*b*, etc. The existing shower unit S can be, therefore, used for multipurposes.

The casing 1-side water-passing holes 5 and 5*a* and the rearmost case 7-side water-passing regions 9, 9*a*, etc. are formed so as not to simultaneously supply water to the different water discharge means 38, 38*a*, etc. It is, therefore, possible to ensure that only desired water discharge means 38, 38*a*, etc. are used.

Since the restriction amount of the spray nozzle 39 is made adjustable, forces of the fine water particles discharged from the spray nozzle 39 can be adjusted. Due to this, magnitudes and forces of the fine water particles can be suited to every individual's taste irrespectively of the pressure of the hot water supplied from the hot water supply system, which pressure differs according to a machine type, a manufacturer, a service period or the like.

If the hot water supply system of the shower unit S is a fuel heater using gas or kerosene and only one spray nozzle 39 is connected while the warm water is used, the hot water system is excessively heavily burdened. As a result, the hot water supply system may possibly be stopped. Besides, since a water discharge amount is small, a negatively charging ratio is low and efficiency for heating the bathroom by spraying the warm water is deteriorated. However, by connecting a plurality of spray nozzles 39, the hand-held sprayer greatly exhibits practical advantages including solving these disadvantages.

The invention claimed is:

1. A hand-held sprayer for selectively providing one of a fine water particle mist, an intermittent shower, and a continuous shower, comprising:

a casing comprising a grip at a lower end and a head at an upper end thereof, the casing including a frontwardly facing large-diameter cylindrical portion formed integrally at a center of the head, the casing including a flow passage therein;

a flexible tube having a tip end attached to the grip portion of said casing;

a pan including a pan fitted body fitted into a front opening of the cylindrical portion, the pan including pan water passing holes;

a first seal for sealing the fitted body of the pan with the cylindrical portion;

a first case having an inner bottom rotatably fitted into a front opening of said pan fitted body, the first case including a plurality of first case water passing holes that are selectively alignable with predetermined ones of the pan water passing holes;

a second seal for sealing an outer peripheral surface of the pan fitted body and an inner peripheral surface of the first case;

a second case having an inner bottom fitted into a front opening of the first case and a plurality of second case water passing holes;

a third seal for sealing an outer peripheral surface of the first case and an inner peripheral surface of the second case;

a third case having an inner bottom fitted into a front opening of the second case and a plurality of third case water passing holes, the third case having a plurality of water discharge grooves formed on a outer peripheral wall thereof for defining a shower water discharge path between the second case and the third case;

a fourth seal for sealing portions of an outer peripheral surface of the second case and an inner peripheral surface of the third case;

a center shaft extending from the cylindrical portion of the casing through the first, second and third cases;

an intermittent spray device fitted into a front opening of the third case, the spray device having a plurality of water intake holes in a rear surface thereof and water discharge holes in a front surface thereof, the intermittent spray device including rotatable vanes located therein; and a switching portion secured to said first case and rotatable with respect to the head of said sprayer, wherein rotation of said switch portion rotates said first case so that various ones of said holes are positionable to provide one of fine water particles as a mist, continuous shower and intermittent shower.

2. The hand-held sprayer of claim 1, further comprising:

attachment ports formed in a peripheral wall of the first case;

a connection tube coupled to the attachment ports;

spray nozzles connected to a distal end of the connection tube, each said spray nozzle including a main nozzle body connected to the connection tube and a cap secured to a front surface of said nozzle body, the cap including a spray hole therethrough dimensioned for outputting fine water particles as a mist.

3. The handheld sprayer of claim 2, wherein the spray nozzles are not spaced symmetrically about the longitudinal axis of the center shaft.

4. The hand-held sprayer of claim 2, wherein the plurality of water discharge grooves and the spray nozzles are concentric with respect to a longitudinal axis of the center shaft.

5. The handheld sprayer of claim 4, wherein the spray nozzles are located outwardly from the longitudinal axis a distance greater than the distance of either the water discharge holes or the water discharge grooves from the longitudinal axis.

6. The handheld sprayer of claim 5, wherein the spray nozzles are not spaced symmetrically about the longitudinal axis of the center shaft.

7. The handheld sprayer of claim 1, wherein said seals comprise O-rings.

8. The hand-held sprayer of claim 1, wherein, with respect to a longitudinal axis projecting transverse from the front face of the casing, said cases are arranged concentrically thereto, and wherein said spray nozzle for outputting fine water particles as a mist is spaced outwardly from the longitudinal axis beyond the various water discharge means.

9. The hand-held sprayer of claim 1, wherein said spray nozzle comprises one of a plurality of spray nozzles, said spray nozzles not being spaced symmetrically about the longitudinal axis.

* * * * *